US008288965B1

(12) United States Patent
Gordin

(10) Patent No.: US 8,288,965 B1
(45) Date of Patent: Oct. 16, 2012

(54) APPARATUS AND METHOD FOR SWITCHING IN ADDED CAPACITANCE INTO HIGH-INTENSITY DISCHARGE LAMP CIRCUIT AT PRESET TIMES

(75) Inventor: Myron K. Gordin, Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 1145 days.

(21) Appl. No.: 12/035,994

(22) Filed: Feb. 22, 2008

Related U.S. Application Data

(60) Provisional application No. 60/891,392, filed on Feb. 23, 2007.

(51) Int. Cl.
*H05B 37/02* (2006.01)

(52) U.S. Cl. ..... 315/360; 315/291; 315/307

(58) Field of Classification Search ..... 315/209 R, 315/224–226, 247, 289, 291, 307, 360, 362
See application file for complete search history.

(56) References Cited

U.S. PATENT DOCUMENTS

| | | | | |
|---|---|---|---|---|
| 4,005,336 | A | 1/1977 | Casella | |
| 4,009,387 | A | 2/1977 | Nuver | |
| 4,189,664 | A | 2/1980 | Hirschfeld | |
| 4,292,570 | A | 9/1981 | Engel | |
| 4,434,388 | A | 2/1984 | Carver et al. | |
| 4,442,382 | A | 4/1984 | Fleck | |
| 4,451,763 | A * | 5/1984 | Sodini | 315/159 |
| 4,475,065 | A | 10/1984 | Bhalla et al. | |
| 4,501,994 | A | 2/1985 | Spreadbury | |
| 4,725,934 | A | 2/1988 | Gordin | |
| 4,816,974 | A | 3/1989 | Gordin | |
| 4,891,562 | A | 1/1990 | Nuckolls | |
| 4,924,109 | A | 5/1990 | Weber | |
| 4,931,701 | A | 6/1990 | Carl | |
| 4,947,303 | A | 8/1990 | Gordin | |
| 4,994,718 | A * | 2/1991 | Gordin | 315/240 |
| 5,075,828 | A | 12/1991 | Gordin | |
| 5,103,143 | A | 4/1992 | Daub | |
| 5,134,557 | A | 7/1992 | Gordin | |

(Continued)

FOREIGN PATENT DOCUMENTS

CA 1288803 9/1991

(Continued)

OTHER PUBLICATIONS

International Search Report for PCT/US2005/005688, International Filing Date Feb. 23, 2005, 3 pages.

(Continued)

*Primary Examiner* — Tung X Le
(74) *Attorney, Agent, or Firm* — McKee, Voorhees & Sease, P.L.C.

(57) ABSTRACT

A method and apparatus for controlling power to relatively high power devices by adding or subtracting capacitance. A plurality of capacitors are connected in parallel. The plurality of capacitors are in series with the device. Operating power to the device can be adjusted by adding or subtracting capacitors in the device circuit. The high powered contactors are controlled by a small power control input from an electronic timer. In one embodiment the electronic timer comprises a digital timer/controller which is programmable to automatically actuate designated contactors at different pre-programmed times sensed to by the timer/controller based on accumulated operating time of the high powered device. The combination allows an easily adjustable yet small sized and relatively inexpensive set of components for adjusting high powered devices.

4 Claims, 4 Drawing Sheets

U.S. PATENT DOCUMENTS

| | | | | |
|---|---|---|---|---|
| 5,161,883 | A | 11/1992 | Gordin | |
| 5,229,681 | A | 7/1993 | Gordin | |
| 5,272,418 | A * | 12/1993 | Howe et al. | 315/159 |
| 5,391,966 | A | 2/1995 | Garrison | |
| 5,434,763 | A | 7/1995 | Hege et al. | |
| 5,442,177 | A * | 8/1995 | Boulos et al. | 250/342 |
| 5,442,261 | A | 8/1995 | Bank | |
| 5,463,285 | A | 10/1995 | El-Hamamsy | |
| 5,469,027 | A | 11/1995 | Uchihashi et al. | |
| 5,475,360 | A | 12/1995 | Guidette et al. | |
| 5,519,286 | A * | 5/1996 | Rodrigues et al. | 315/159 |
| 5,751,116 | A * | 5/1998 | Thomas et al. | 315/240 |
| 5,856,721 | A | 1/1999 | Gordin | |
| 5,962,988 | A * | 10/1999 | Nuckolls et al. | 315/291 |
| 6,031,340 | A | 2/2000 | Brosius | |
| 6,075,326 | A | 6/2000 | Nostwick | |
| 6,114,816 | A | 9/2000 | Nuckolls | |
| 6,150,772 | A | 11/2000 | Crane | |
| 6,172,469 | B1 | 1/2001 | Kern | |
| 6,191,568 | B1 | 2/2001 | Poletti | |
| 6,194,847 | B1 * | 2/2001 | Hollaway | 315/360 |
| 6,207,943 | B1 | 3/2001 | Smelker | |
| 6,215,254 | B1 | 4/2001 | Honda et al. | |
| 6,316,923 | B1 | 11/2001 | Poletti | |
| 6,320,323 | B1 | 11/2001 | Buell | |
| 6,373,201 | B2 | 4/2002 | Morgan et al. | |
| 6,376,996 | B1 | 4/2002 | Olson | |
| 6,501,231 | B1 | 12/2002 | Hyland | |
| 6,515,430 | B2 | 2/2003 | Kayser | |
| 6,545,429 | B1 | 4/2003 | Flory, IV | |
| 6,545,433 | B2 | 4/2003 | Beij | |
| 6,577,075 | B2 | 6/2003 | Romano et al. | |
| 6,583,574 | B2 | 6/2003 | Ann | |
| 6,681,110 | B1 | 1/2004 | Crookham et al. | |
| 6,713,973 | B2 * | 3/2004 | Erhardt | 315/291 |
| 6,774,768 | B2 * | 8/2004 | Flory, IV | 340/309.16 |
| 6,798,153 | B2 | 9/2004 | Mattos et al. | |
| 6,864,645 | B2 * | 3/2005 | Sun et al. | 315/308 |
| 6,906,476 | B1 * | 6/2005 | Beatenbough et al. | 315/276 |
| 7,038,390 | B2 * | 5/2006 | Swami et al. | 315/112 |
| 7,176,635 | B2 | 2/2007 | Gordin | |
| 7,176,867 | B2 | 2/2007 | Lee | |
| 7,385,360 | B2 | 6/2008 | Dluzniak | |
| 7,429,828 | B2 | 9/2008 | Cleland et al. | |
| 7,432,670 | B2 * | 10/2008 | Yamashita et al. | 315/362 |
| 7,589,480 | B2 * | 9/2009 | Greenwood et al. | 315/307 |
| 7,675,251 | B2 | 3/2010 | Gordin | |
| 7,956,551 | B1 | 6/2011 | Gordin | |
| 7,956,556 | B1 | 6/2011 | Gordin et al. | |
| 2002/0089293 | A1 | 7/2002 | Romano et al. | |
| 2002/0185980 | A1 | 12/2002 | Beij et al. | |
| 2003/0025463 | A1 | 2/2003 | Mattas et al. | |
| 2003/0090215 | A1 | 5/2003 | Beasley | |
| 2005/0184681 | A1 | 8/2005 | Gordin et al. | |
| 2006/0071610 | A1 | 4/2006 | Dluzniak | |
| 2007/0001617 | A1 * | 1/2007 | Pogodayev et al. | 315/224 |
| 2007/0040513 | A1 | 2/2007 | Cleland et al. | |
| 2007/0043540 | A1 | 2/2007 | Cleland | |
| 2007/0043541 | A1 | 2/2007 | Cleland et al. | |
| 2007/0070571 | A1 | 3/2007 | Gordin et al. | |
| 2008/0048590 | A1 * | 2/2008 | Hagbi | 315/360 |

FOREIGN PATENT DOCUMENTS

| | | | |
|---|---|---|---|
| DE | 195 40 326 | A1 | 4/1997 |
| DE | 199 12 517 | A1 | 9/2000 |
| EP | 0 439 358 | A2 | 1/1991 |
| EP | 0439358 | A2 | 7/1991 |
| EP | 0 536 877 | A1 | 4/1993 |
| EP | 0 669 788 | A1 | 8/1995 |
| JP | 6163163 | A | 6/1994 |
| JP | 9-180886 | | 10/1996 |
| TW | I148059 | | 12/1990 |
| TW | I230912 | | 4/2005 |
| WO | WO 2005/084086 | A1 | 9/2005 |

OTHER PUBLICATIONS

Venture Lighting, Venture Technical Information, BALLASTS, © 2006 and Ballast Types © 2006 (6 pages).
Venture Lighting International, Range of Metal Halide Maintenace, HID Systems Sourcebook, 2000, p. 143).
Gordin, Co-Pending U.S. Appl. No. 11/842,853.
Musco, "Multi-Watt allows two light levels, reduce energy costs", copyright 1992, 2002 Musco Lighting, (4 pages).
English abstract of JP 9180886 (1 page).
English translation of DE 19912517 (8 pages).
English translation of DE 19540326 (13 pages).
English Abstract of JP 6163163A (1 page).
English Abstract of DE 199 12 517 (1 page).
English Abstract of DE 195 40 326 A1 (1 page).
English Abstract of EP 0 669 788 (1 page).
English Abstract of WO 2005/084086 (1 page).
English translation of Taiwan I230912, (23 pages).
English translation of Taiwan 148059 (56 pages).
English Translation of JP09180886A, published on Jul. 11, 1997, 8 pages.
English Abstract of WO2005084086, published on Sep. 9, 2005, 1 page.

* cited by examiner

APPARATUS AND METHOD FOR SWITCHING IN ADDED CAPACITANCE INTO HIGH-INTENSITY DISCHARGE LAMP CIRCUIT AT PRESET TIMES

CROSS-REFERENCE TO RELATED APPLICATIONS

This application claims priority under 35 U.S.C. §119 to a provisional application Ser. No. 60/891,392 filed Feb. 23, 2007, herein incorporated by reference in its entirety.

I. BACKGROUND OF THE INVENTION

A. Field of the Invention The present invention relates to changing operating power to a high-intensity discharge (HID) lamp by adding (or removing) capacitance, and in particular, by incrementally adding (or removing) capacitance at predetermined, separated times.

B. Problems in the Art

U.S. Pat. No. 7,176,635, entitled "Apparatus and Method for Compensating for Reduced Light Output of a Light Source Having a Lumen Depreciation Characteristic Over Its Operational Life" describes one approach for changing operating power to an HID lamp by changing capacitance in the lamp circuit. U.S. Pat. No. 7,176,635, incorporated by reference in its entirety herein, also discusses why changing operating power can be beneficial to operation of such lamps and why changing capacitance is an economical, efficient, and effective way of doing so. A commercial version is available from Musco Corp., Oskaloosa, Iowa USA under the trademark SMART LAMP®. As explained in U.S. Pat. No. 7,176,635, one purpose of additional operating power is to compensate for lamp lumen depreciation (LLD) that occurs in most of these types of lamps.

One embodiment in U.S. Pat. No. 7,176,635 uses a very robust, low cost, low complexity combination of components. In the first embodiment, an electric timer motor rotates cams that, in turn, actuate switches, relays or contactors to sequentially switch capacitors to increase capacitance to the lamp circuit at times determined by the electric timer motor and cams. The elegance of this solution is that the timer motor is electrically connected into the lamp circuit. It only runs when the lamp is operating. Therefore, it does not run constantly, but rather keeps track of cumulative operating time of the lamp.

As explained in U.S. Pat. No. 7,176,635, one use of such circuits is for sports lighting. A sports lighting system has a normal effective life of decades, and over those decades the lights are normally operated for thousands of hours, usually for three to five hours a day at most. The electrical timer/cam combination thus is energized (provided electrical power) whenever the lamp is energized. The cams rotate very slowly and are preconfigured to rotate to a position that operates a switch at a predetermined time when additional capacitance to the lamp is desired to provide additional operating power to the lamp.

The electromechanical solution of the electric timer motor/cam is not only economical, but is quite robust. The combination is similar to combinations in use for decades in washing machines. As a mass market consumable, cost of washing machines is a critical purchasing decision factor. The electric motor/cam combination controls the various states and cycles of a washing machine, and has been developed over time to be a widely used, reliable, and economical component. A washing machine exposes its components to substantial vibration and moisture over its expected life (also decades). These conditions are similar to what sports lighting experiences—vibration from wind and other forces, as well as rain, snow, wind, temperature extremes, etc.; although outdoor lighting systems experience more dramatic forces, including lightning, since they usually have metal parts elevated high above the ground. An electromechanical solution for switching in or out capacitance in a sports lighting system was discovered to be economical but also robust for outdoors environments, especially that it is much more resistant to damage or effect by lightning than electronic components.

In addition to the first embodiment disclosed, U.S. Pat. No. 7,176,635 discloses other ways in which an electrical timer motor could change operating power to the lamp through changing of capacitance. Some involve somewhat more complexity and cost, but they predominantly rely upon an electromechanical timer motor/cam combination.

Systems are known for changing operating power of other types of lamps or light sources, or other devices. For example, a number of publications disclose ways of adjusting operating power to indoor florescent light fixtures. They usually use electronic components, at least in part, are intended for indoor operation, and thus are not exposed to substantial moisture, vibration, or lightning. They also are usually not intended for high wattage or high power. Therefore, different considerations control those designs.

Therefore, although U.S. Pat. No. 7,176,635 presents solutions that work reasonably well, and power-adjustment systems for other types of lamps or devices use more electronic solutions, it is apparent that for wide-area, high power HID lighting there are many factors that must be considered, and they can differ dramatically from indoor lighting or device solutions. Thus, there is room for alternative solutions for practical power adjustment of HID light sources, fixtures, and systems.

The present invention speaks to alternative solutions to changing operating power to an HID lamp by changing capacitance in the lamp circuit.

II. SUMMARY OF THE INVENTION

A. Objects, Aspects, Features, and Advantages of the Invention

An object of the present invention is to provide an alternative solution to those provided in U.S. Pat. No. 7,176,635.

Another object of the invention is to provide an alternative or improvement over problems and deficiencies in the art.

Additional objects, features, advantages, or aspects of the present invention include an apparatus or method for changing operating power to an HID light source or other high power light source or device which:

1) balances cost, robustness, and complexity.

2) can improve volumetric efficiency in the sense of providing a solution that can occupy a smaller volume than some other solutions and maximize capacitance per cubic inch.

3) tries to keep complexity relatively minimal.

4) can be effective in high wattage applications.

5) requires a minimum amount of calibration, or programming, or other technical set-up steps.

These and other objects, features, advantages, or aspects of the present invention will become more apparent with reference to the accompanying specification and claims.

B. Aspects of the Invention

A method according to one aspect of the present invention adds at least one additional capacitor in parallel with a base or primary capacitor in an HID lamp circuit. A switch, for example in the form of a contactor that can handle relatively high current levels, is placed in series with each additional capacitor. The switch and added capacitor are in parallel with the base capacitor. An electronic timer device is operatively connected in the lamp circuit so that power is supplied to it, and it accumulates time, only when the lamp circuit is energized. The electronic timer device is preset or programmed to cause actuation of the switch, or alternatively multiple switches, at predetermined time interval(s) after an initial set point. If the switch is a contactor, the timer device can essentially generate a signal at a predetermined time to actuate the appropriate contactor (make it conducting) and bring the capacitance into the lamp circuit. The contactor would remain closed until the timer device is reset.

An apparatus according to one aspect of the invention allows the method described in the preceding paragraph to be practiced by components described therein. If there is more than one secondary capacitor to switch into the lamp circuit, there could be one switch or contactor for each supplemental or secondary capacitor. Each switch could have its own separate electronic timer device, each of which could accumulate operating time of the lamp and each could be programmed to actuate its corresponding switch at a different time relative to a common beginning time or set point. Alternatively, a single timer device could be set to actuate each switch at different times.

III. BRIEF DESCRIPTION OF THE DRAWINGS

IV. DETAILED DESCRIPTION OF EXEMPLARY EMBODIMENTS OF THE INVENTION

A. Overview

For a better understanding of the invention, specific examples will now be described in detail. It is to be understood that each is but one form or embodiment the invention can take. Variations obvious to those skilled in the art will be included within the invention. The invention is not limited by these examples.

These examples will be described in the context of relatively high wattage HID lamp 100 (see FIG. 1A) of the type used in sports lighting (e.g., 1,000 watt or higher rated operating power metal halide HID lamp available from a variety of commercial sources). It is to be understood that the invention has applicability beyond sports lighting, for example to other high power light sources, analogous wide area lighting applications or even other contexts or applications.

The exemplary embodiments are also described with respect to control of operating power to one HID lamp or light source. As can be appreciated by those skilled in the art, these circuits can be applied to plural lamps or light sources.

B. Apparatus of First Exemplary Embodiment

Figure 1A:
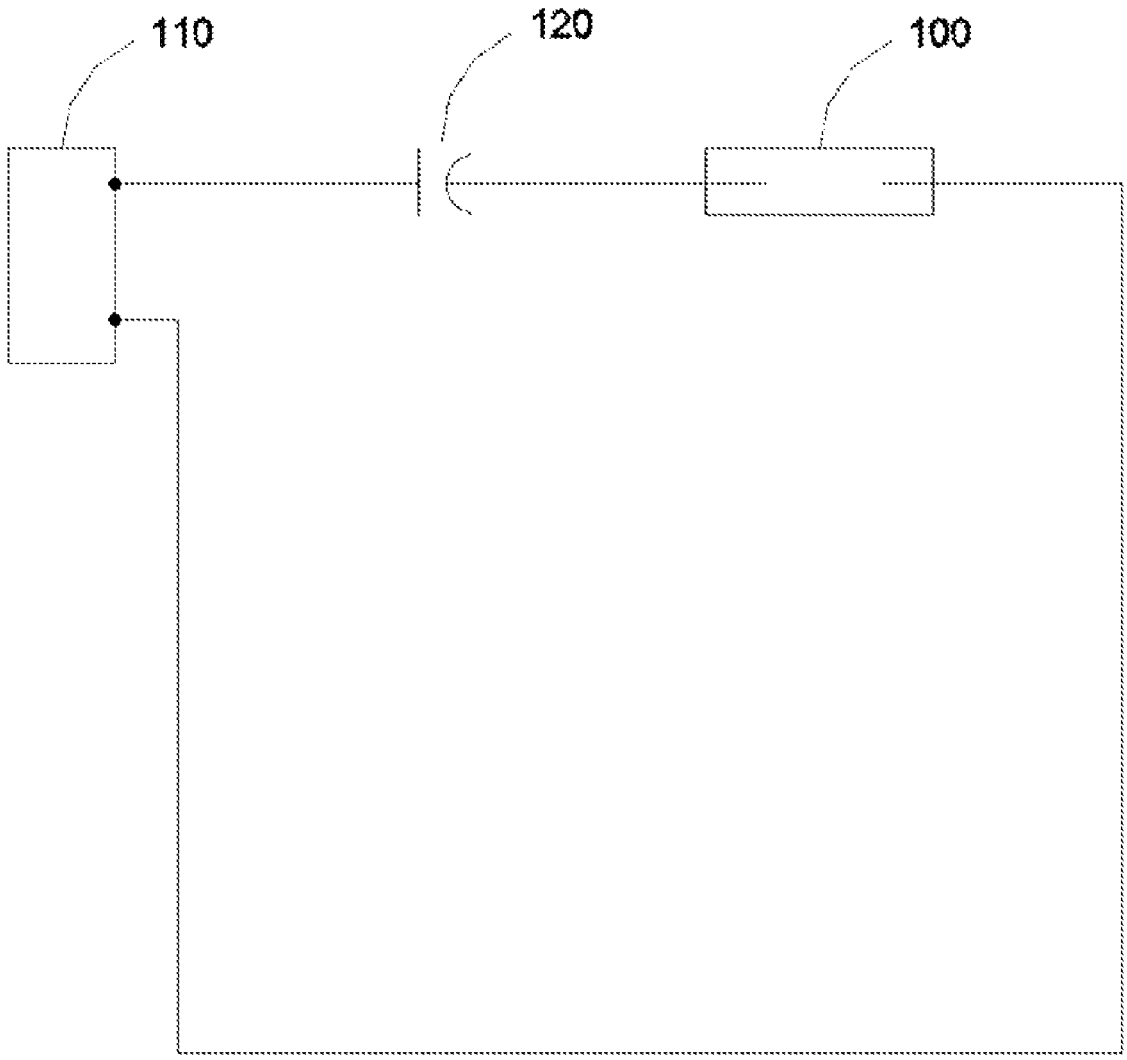
FIG 1A (Prior Art)
FIG. 1A is an electrical schematic of a typical HID lamp circuit.

FIG. 1A illustrates in schematic form a conventional HID lamp 100 (1000 or 1500 watt rated operating power metal halide) having a lamp circuit operatively connected to a source of electrical power such as ballast 110. A primary, base, or main lamp capacitor 120 is connected in series with lamp 100 and contributes at least partially to determining operating power of lamp 100. It is to be understood that the schematic of FIG. 1A does not include several other standard conventional components for the lamp circuit, which can be seen in the circuits of U.S. Pat. No. 7,176,635.

Figure 1B:
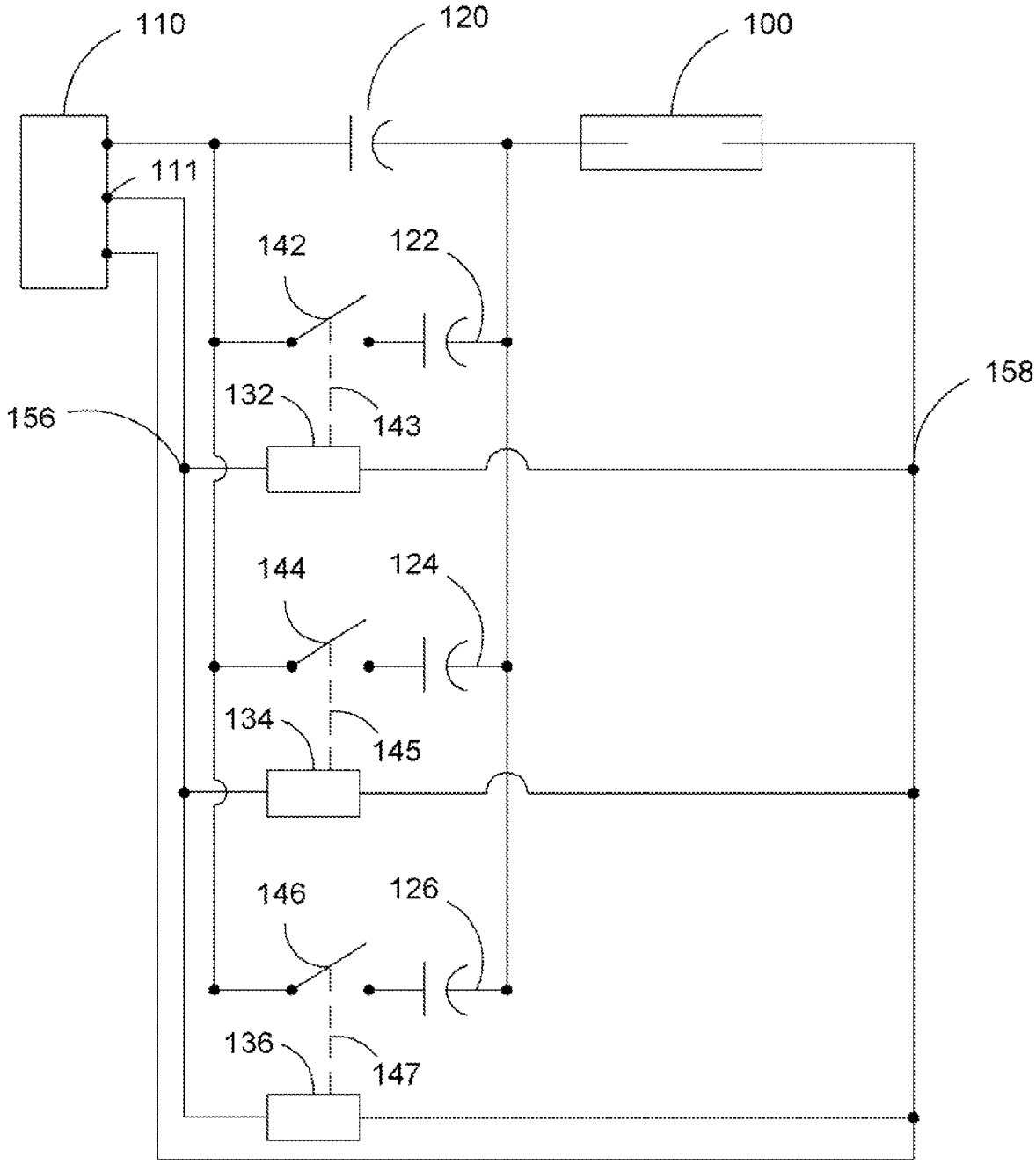
FIG. 1B is an electrical schematic of an exemplary embodiment according to the present invention.

FIG. 1B shows that the first exemplary embodiment added to the basic lamp circuit of FIG. 1A. The circuit of FIG. 1B adds three capacitors 122, 124, and 126 in parallel with the main capacitor 120. These capacitors become active in the lamp circuit only when their corresponding contactors 142, 144, and 146 are closed. It is to be understood that although three additional capacitors and associated components are shown in FIG. 1B, the principles and methods discussed below apply equally well to the addition of any number of additional capacitors (i.e. at least one or more) in parallel with a main capacitor.

In this exemplary embodiment, main capacitor 120 is approximately 25-35 micro farads. Secondary capacitors 122, 124, and 126 are each approximately 2 micro farads. The addition of capacitor 122 into the lamp circuit would thus add about 6% to 8% additional capacitance and, by well-known principles of electricity and physics, increase operating wattage to lamp 100 by a generally proportional amount. Additional capacitor 124 would then add a further similar generally proportional amount, as would capacitor 126.

As described in detail in U.S. Pat. No. 7,176,635, one application of the circuit of FIG. 1B would be to operate HID lamp 100 with only the primary capacitor 120 in the lamp circuit for a given period of cumulative operating time (for example 100 hours). In FIG. 1B, electronic timer 132 is connected to power tap 111 which is energized whenever lamp 100 is energized. Power tap 111 could be a different voltage (e.g. 120 V or 240 V) tap, but any source of power could be used that is (a) of an acceptable voltage to energize timer 132 and (b) energized only when lamp 100 is energized (or in some other way supplies necessary power to timer 132 only when the lamp is energized). Timer 132 can operate contactor 142 through interface 143, which places capacitor 122 in parallel with capacitor 120. As is well known in the art, interface 143 (as well as interfaces 145 and 147 below) can merely be an electrical connection.

Similar timer 134 can also be connected to power tap 111. Timer 134 can operate contactor 144 through interface 145 to place capacitor 124 in parallel with capacitor 120.

Similar timer 136 can also be connected to power tap 111. Timer 136 can operate contactor 146 through interface 147 to place capacitor 126 in parallel with capacitor 120.

Timers 132, 134, 136 would therefore all concurrently measure cumulative operating time of lamp 100. Whenever operating power is supplied to lamp, each of those timers would accumulate operation time. Whenever operating power is disconnected from lamp 100, the timers would be dormant and not accumulate time. In this way, cumulative operating time of lamp 100 is monitored. Each timer could be set to the same beginning or set point upon initial installation or replacement of lamps.

For this embodiment, each timer 132, 134, 136 has a sequential timing function along with memory storage and an output control signal to activate its contactor. These timers could be commercial, off-the-shelf electronic devices, which are readily available in many different types and known to those familiar in electronics. For example, the memory storage may be of the bubble memory technology or a more advanced microprocessor. One example is a model LE4S series digital timer/controller from SenSource of Youngstown, Ohio (USA). Details and specifications can be found in the electronically published SenSource LE45 spec sheet at http://sensource.biz/docs/LE4S.pdf, incorporated by reference herein.

The example of the Model LE4S series device for timers 132, 134, and 136 can have the following characteristics. It is called a digital timer/controller, as it includes a programmable microprocessor that can control a variety of functions. It can include a back-lit LCD. It has memory retention if power is removed. It has a time range of from a fraction of a second to 9,999 hours. It can include a lock function to protect the programming once set. It comes in a small 48 millimeter wide by 48 millimeter high by approximately 100 millimeter deep housing. Its components are rated for temperatures between −10 and 55° C. and relative humidity levels from 35% to 85%. It is durable and resistant to vibration and shock. It has a standard single pole/double throw timed function that is resettable manually by pushing a button or key. The LCD and output does not operate when power is cut off. The time for instructing switching of the single pole/double throw switch can be changed from buttons on the device that can easily and quickly either increment the switching time up or down within the range. Operation of the timing of cumulative operating hours can be automatically linked to those times when lamp operating power is on. Digital timer/controller 132 provides a standard single pole/double throw (SPDT) (timed) single relay output (250VAC 2A resistive load) to open or close a contactor 142. This relay output can switch current from power tap 111 to provide control current to the operating coil of contactor 142. Alternatively other power that could be available within the control enclosure (e.g. 12-24VDC) could be provided to the relay contacts to perform the same function. This type of control circuit is well known in the industry, and is therefore not shown in detail in the figures. As is well known in the industry, a very small amount of power is required to control contactor 142, which controls a significantly higher current load.

Contactor 142 can be a commercially available electrically controlled switch which uses an electromagnetic coil to provide mechanical force for switching a power circuit (here the capacitor circuit for the high power lamp). Contactor 142 is fitted with Normally Open contacts. When the control input from digital timer/controller 132 is actuated by the closing of the contact at its SPDT output, current passes through an electromagnet in contactor 142, which causes the driving force to close the contacts in contactor 142, which closes the circuit to capacitor 122 to add that capacitance to the lamp/main capacitor circuit.

Figure 2:
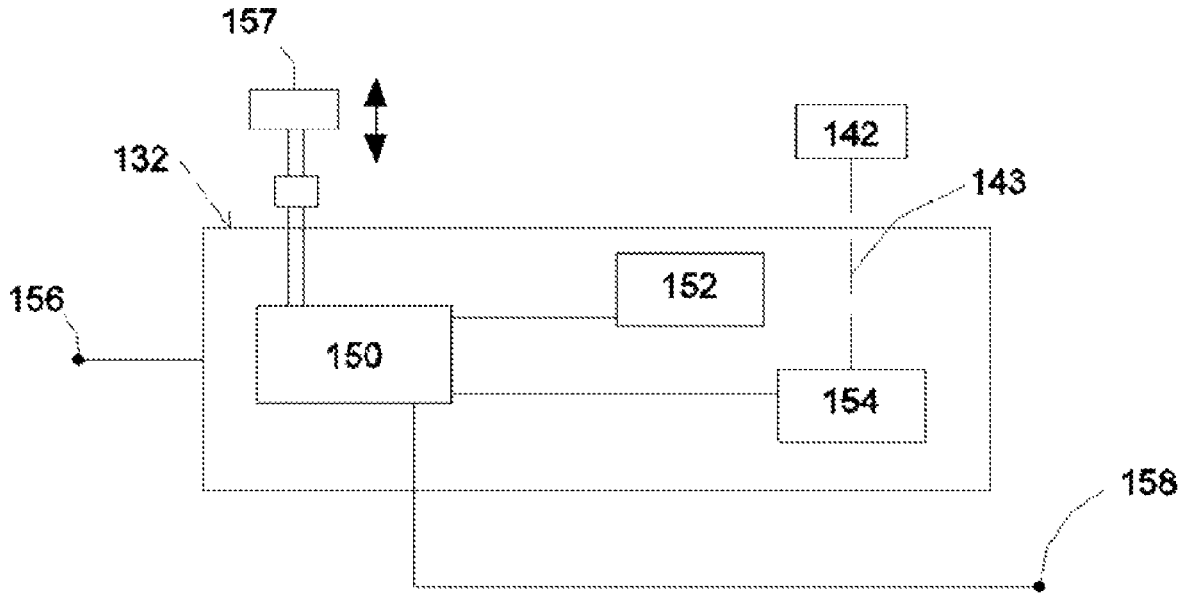
FIG. 2 is a block diagram of one example of a timer device that could be used in the circuit of FIG. 1B.

FIG. 2 provides a schematic block diagram of functions of timer 132 (timers 134 and 136 could be either identical or operationally similar) and external contactor 142. An internal cumulative operating timing function 150 in timer 132 is connected in the lamp circuit at connections 156 and 158. Memory 152 can be programmed by conventional means to store any reasonable desired switching time, such that each individual timer 132, 134, and 136 could store the correct unique switching times for its corresponding capacitor 122, 124, or 126 respectively.

In this example, a first switching time (for timer 132, contactor 142, and capacitor 122) is 100 hours of cumulative operating time of lamp 100 from a set point (e.g. when the lamp is new or stabilized). A second switching time, which could be used by timer 134, contactor 144, and capacitor 124, is 1,000 hours of cumulative operating time from the same set point. A third switching time, which could be used by timer 136, contactor 146, and capacitor 126, is 2,000 hours of cumulative operating time from the same set point. Memory 152 of each timer 132, 134, and 136 therefore communicates with its corresponding timer 150. In the case of timer 132, when the switching time occurs, timer 150 sends a signal to an actuator 154 which causes actuation of contactor 142 through interface 143. This signal can be a standard SPDT relay output which provides a control voltage/current through a wired connection 143 to the control input of the conventional high current contactor 142. Other methods and components which are well-known in the industry can be used to achieve actuation of a high current contactor operatively connected in a high power circuit by a relatively low power electronic timer device.

Referring again to FIG. 1B, this relatively non-complex combination therefore keeps track of a preset period of cumulative operation time for lamp 100 and then automatically switches capacitor 122 into the lamp circuit to increase operating power to lamp 100 by an initial increment.

In a similar manner, timer 134, which has kept track of the same cumulative operating time as timer 132, would count until reaching a second, longer, preset cumulative time. It would then cause actuation of its contactor 144 through interface 145 to switch into the lamp circuit an additional capacitor 124 to add further incremental operating power to lamp 100 (both capacitor 122 and connector 124 would be switched into the lamp 110 and main capacitor 120 circuit).

Finally, timer 136, which has also kept track of the same operating time as timer 132, would actuate contactor 146 through interface 147 to switch in, at a third, still longer cumulative operating time, the last added incremental capacitance of capacitor 126 to still further increase operating power to lamp 100 (all three secondary capacitors 122, 124, and 126 would by then be switched into the lamp 100/main capacitor 120 circuit).

As explained above and in U.S. Pat. No. 7,176,635, the additional power could be used to periodically compensate for LLD. In such an application, its intent is to restore light level from lamp 100 periodically to at or near an original reference level.

As can be further appreciated, timers 132, 134, and 136, contactors 142, 144, and 146, and secondary capacitors 122, 124, and 126 can be quite inexpensive. They only have to perform quite simple, dedicated functions at quite widely spaced-apart times. The devices can be off-the-shelf, mass produced, non-complex components. Therefore, the add-on circuitry to accomplish the periodic increase in operating power to a lamp 100 can be, in total, relatively economical.

But further, timers 132, 134, 136 (and any additional timers) can be quite small in size (including in total volume). Therefore, even though in this example a separate timer is used for each capacitor, they do not occupy substantial additional space or volume. Such timers can be purchased so inexpensively that it is economically viable to use one timer per capacitor. In the context of sports lighting, along with economical component price, minimal space usage can also be important. These types of electronic timers can occupy a volume of approximately one cubic inch or less, making them substantially smaller than conventional electromechanical timer/cam combinations. Although possibly not as robust and resistant to electrical surges and lightning as comparable mechanical timers, balancing of the factors related to relatively high power light sources may make it desirable to accept the risk and save space.

B. Method

A method of use of the circuit of FIG. 1B has been explained above and in U.S. Pat. No. 7,176,635. It is operatively connected into the lamp circuit for lamp 100. Each timer 132, 134, 136 has its memory programmed to a different cumulative operating time (e.g., the first, second and third switching times); in this example from the same set point or time. The level of capacitance of capacitors 122, 124, and 126 is pre-selected. Both the switching times and capacitances are selected based on the lumen depreciation characteristic or curve for the particular lamp 100. This is explained in U.S. Pat. No. 7,176,635. However, with regard to capacitors, their number, their capacitance values, and the purpose(s) they are used for switching in additional power can, of course, vary according to need or desire. Likewise, this method of using switchable levels of capacitance can be implemented in power circuits with devices other than HID lamps.

As stated before, even though the circuit of FIG. 1B uses three timers 132, 134, and 136, they could each be programmed to begin monitoring cumulative operating time of lamp 100 at the same set point (i.e. each would be reset or "zeroed" at or about the same time). They would continue to monitor total operating time of lamp 100 and therefore would each have approximately the same cumulative operating time at any point in time. However, because each has a memory set to a different switching time, its associated contactor would be actuated at a unique cumulative time in order to switch in the secondary capacitors at differing times. Alternatively, each timer could be programmed relative to different set points or to different reference points or times.

Because the circuit of this example is configured to add in incremental capacitance during the normal operating life of one lamp 100, after the third switching time and the addition of capacitor 126 to the lamp circuit (or at whatever point the last capacitor is switched in, depending on the number of switching intervals designed into the system), lamp 100 would be operated under the combined capacitance of capacitors 120, 122, 124, and 126 (or as many additional capacitors as designed into the system) for as long as either (a) the lamp continues to operate (does not fail), or (b) the end user of the lamp or lighting system or the maintenance service company for the lighting system allows it to run.

Each timer 132, 134, and 136 has a reset button 157 (see FIG. 2) that could be manually operated to reset cumulative operating time back to a "0" or set point at such a time that lamp 100 is replaced. The reset would also cause the corresponding contactor to open (become non-conducting). In that manner, when lamp 100 is replaced, the circuit of FIG. 1B would be reset to its initial condition as when new. It would then begin monitoring cumulative lamp operating time for the new lamp 100, and repeat the addition of incremental capacitance according to first, second, and third switching times, the same as with the previous lamp.

As can be appreciated, this resetting is very simple. After replacement of a lamp, in this example the worker pushes three buttons (one for each timer 132, 134, and 136) thereby resetting the system. Furthermore, changing the switching time for the memory for each timer can be done relatively easily by known methods (e.g. reprogramming memory) if so desired. With timers 132, 134, and 136, there could be selection keys or buttons on the timer and a display showing the switching time. The buttons could be pushed to set or select any switching time (relative to a set point) between an available range (e.g. a fraction of an hour to 9999 hours).

Still further, because of the relatively low cost of these components and their relatively small size, additional capacitors, contactors, and timers could easily and practically be added if additional incremental changes in capacitance would be needed.

C. Options and Alternatives

It will be appreciated that variations, different configurations, and different values can be utilized with the invention. The foregoing exemplary embodiment provides one example of a form the invention can take and gives general principles regarding it. Variations obvious to those skilled in the art will be included within the invention.

As mentioned, switching times can be changed according to desire. The number of capacitance additions can be changed according to desire. The precise way in which the timers are connected into the lamp circuit can vary. Use of a contactor can be replaced with other devices that produce a similar function. The precise make up of the timers can vary as well as how they are programmed and reset and how they actuate a contactor or analogous device.

Figure 3:
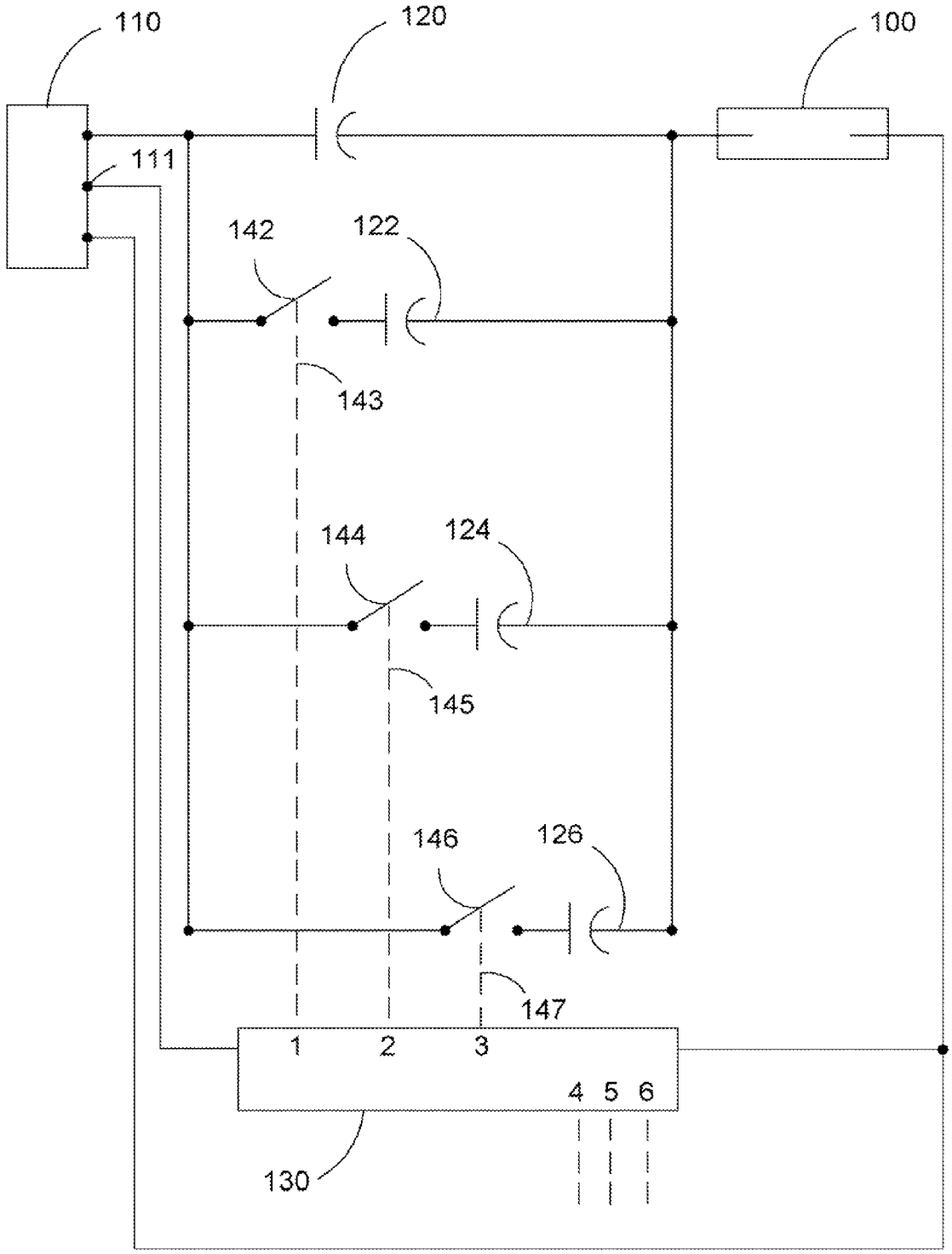
FIG. 3 is an alternative exemplary embodiment according to the present invention.

A specific alternative embodiment is shown in FIG. 3. It operates on essentially the same principles as the embodiment of FIG. 1B with the following major difference. Instead of three electronic timers 132, 134, and 136 (FIG. 1B), a single electronic timer 130, which is operationally similar to timer 132 described in FIG. 2, is placed in the lamp circuitry and monitors cumulative operating time of lamp 100 by cumulatively recording when operating power is applied to lamp 100. It differs from timer 132 in that it is required to have as many separate programmable time memories or switching times as are necessitated by the number of separate capacitors to be switched into the lighting circuit. For three incremental power level increases, timer 130 as described in this alternative embodiment is programmable to have first, second, and third switching times and has a mechanism to actuate contactor 142 at the first switching time, contactor 144 at the second switching time, and contact 146 at the third switching time. Interfaces 143, 145 and 147 are operatively connected between timer 130 and the respective contactors 142, 144, and 146. In this way, a single timer 130 can control multiple capacitors (as opposed to a timer device for each capacitor). This can further potentially reduce cost or space. A potential drawback of this configuration compared to the multiple timer configuration of the first embodiment is that in the event of single timer device malfunction or failure no remaining capacitance additions would occur. However, balancing of factors may make it desirable to accept the risk for the sake of space savings or other considerations.

If using a single timer/controller 130, it could either have outputs for each contactor it controls at different times, or could have some internal or external circuit that would either route the appropriate instruction to the appropriate contactor at the appropriate time, or block out the contactors that are not relevant to the particular instruction at the particular time. A variety of ways to have a single timer/controller programmed to operate multiple contactors at different times are possible.

FIG. 3 also indicates that a single timer 130 could have additional outputs and control multiple contactors, either based on the same three switching times or different switching times (e.g. outputs 4, 5, 6). Further, timer 130 could have virtually any number of outputs and programmable times to control many more contactors for many more capacitors. This would allow one timer to be used for more levels of capacitance for a single lamp 100, or control the same number of incremental steps (e.g. one, two, three, or more) for two or more lamps 100.

What is claimed is:

1. An apparatus for controlling operating power of a high power HID lamp in a lamp circuit, comprising:

a. an HID lamp circuit operatively connected to a source of electrical power and including a primary capacitor in series with the lamp;

b. a first secondary capacitor in parallel with the primary capacitor;

c. a switching device in series with the first secondary capacitor;

d. an electronic timer device operatively connected in the lamp circuit to record cumulative time in which power is connected to the lamp in the lamp circuit;

e. an interface between the timer device and the switching device;

f. the timer device being programmable or presettable to generate a signal or actuate the interface upon reaching a first switching time that is based on cumulative operation time of the lamp; and g. one or more additional capacitors and switching devices in parallel with the primary capacitor and first secondary capacitor, and in operative communication with the timer device.

2. The apparatus of claim 1 wherein the timer device is a single timer device programmable for as many different switching times as there are switching devices.

3. The apparatus of claim 1 further comprising a timing device for each switching device.

4. The apparatus of claim 1 further comprising operating the switching devices to compensate for lamp lumen depreciation.

* * * * *